US010114340B2

(12) United States Patent
Di Domenico et al.

(10) Patent No.: US 10,114,340 B2
(45) Date of Patent: Oct. 30, 2018

(54) OPTIMISED TIMEPIECE MOVEMENT

(71) Applicant: The Swatch Group Research and Development Ltd, Marin (CH)

(72) Inventors: Gianni Di Domenico, Neuchatel (CH); Jerome Favre, Neuchatel (CH); Dominique Lechot, Les Reussilles (CH); Baptiste Hinaux, Lausanne (CH); Olivier Matthey, Grandson (CH); Jean-Jacques Born, Morges (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/672,478

(22) Filed: Aug. 9, 2017

(65) Prior Publication Data

US 2018/0113423 A1 Apr. 26, 2018

(30) Foreign Application Priority Data

Oct. 25, 2016 (EP) ..... 16195405

(51) Int. Cl.
*G04B 17/26* (2006.01)
*G04C 5/00* (2006.01)
(Continued)

(52) U.S. Cl.
CPC ..... *G04C 5/005* (2013.01); *G04B 15/06* (2013.01); *G04B 15/10* (2013.01); *G04B 17/10* (2013.01); *G04B 17/26* (2013.01)

(58) Field of Classification Search
CPC ..... G04C 5/005; G04C 5/00; G04B 15/06; G04B 15/10; G04B 17/10; G04B 17/26
See application file for complete search history.

(56) References Cited

U.S. PATENT DOCUMENTS 9,715,217 B2 * 7/2017 Di Domenico ..... G04C 5/005
9,804,570 B2 * 10/2017 Winkler ..... G04C 5/005
(Continued)

FOREIGN PATENT DOCUMENTS

JP 52-040366 3/1977
WO WO 2015/097172 A2 7/2015

OTHER PUBLICATIONS

European Search Report dated Apr. 24, 2017 in European Application 16195405.2 filed on Oct. 25, 2016 (with English Translation of Categories of cited documents).

*Primary Examiner* — Sean Kayes
(74) *Attorney, Agent, or Firm* — Oblon, McClelland, Maier & Neustadt, L.L.P.

(57) ABSTRACT

Timepiece movement including a flexible strip resonator cooperating with a magnetic escapement mechanism, wherein an escape wheel set includes tangential magnetized areas repelling first magnetized areas of an inertial element of the resonator, this movement includes isochronism correction means combining the first magnetized areas and compensating magnets on the escape wheel set, each arranged in proximity to a tangential magnetized area and producing a leakage field in a different direction from that of the field of the tangential magnetized area, the leakage field intensity being low compared to that of the field of the second tangential magnetized area, and this leakage field interacting with one of the first magnetized areas to produce a low variation in the operation of the resonator mechanism.

15 Claims, 4 Drawing Sheets

(51) Int. Cl.

| | |
|---|---|
| ***G04B 15/06*** | (2006.01) |
| ***G04B 15/10*** | (2006.01) |
| ***G04B 17/10*** | (2006.01) |

(56) References Cited

U.S. PATENT DOCUMENTS

| | | | | |
|---|---|---|---|---|
| 9,891,591 | B2 * | 2/2018 | Di Domenico ..... | G04C 5/005 |
| 2016/0357155 | A1 | 12/2016 | Di Domenico et al. | |
| 2017/0038737 | A1 * | 2/2017 | Di Domenico ..... | G04C 5/005 |

* cited by examiner t = 0 t = T/8 t = T/4 t = 3T/8 t = T/2 t = 5T/8 t = 3T/4 t = 7T/8

OPTIMISED TIMEPIECE MOVEMENT

This application claims priority from European Patent Application No. 16195405.2 filed on Oct. 25, 2016, the entire disclosure of which is hereby incorporated herein by reference.

FIELD OF THE INVENTION

The invention concerns a mechanical timepiece movement comprising a strip resonator mechanism that includes at least one inertial element oscillating about a first pivot axis under the action of mechanical elastic return means comprising a plurality of flexible strips, fixed, on the one hand, directly or indirectly, to a structure of said resonator mechanism, and on the other hand, directly or indirectly, to said at least one inertial element, said resonator mechanism being coupled to a magnetic escapement mechanism which includes at least one escape wheel set pivoting about a second pivot axis and subjected to a torque exerted by at least one energy source, and said at least one inertial element comprising at least two first magnetized areas at its periphery, arranged to cooperate directly with second magnetized areas comprised in one said escape wheel set and in partial superposition therewith in projection onto a projection plane perpendicular to said first pivot axis.

The invention also concerns a watch including at least one such movement.

The invention further concerns a magnetic escape wheel arranged to pivot about a second pivot axis, and comprising magnetized areas at its periphery.

The invention concerns the field of timepiece movements comprising strip resonators, and including magnetic escapement mechanisms.

BACKGROUND OF THE INVENTION

Magnetic escapements have been known since the 1960s and 1970s and were the subject of the following patent applications: U.S. Pat. No. 2,946,183 in the name of Clifford, JPS 5240366, JPS 5245468U, JPS 5263453U. These devices are often difficult to incorporate in a watch, because of their bulk. Above all, they have the drawback of anisochronism, i.e. the maintenance of oscillations perturb the operation of the resonator, and the value of this perturbation varies with the amplitude of oscillation.

Patent applications EP 2891930 and WO2015 097172 in the name of THE SWATCH GROUP RESEARCH & DEVELOPMENT Ltd propose arrangements which can considerably reduce the perturbation caused by the maintenance of oscillations, so that its variation with amplitude becomes negligible. However, in practice it is difficult to design an ideally isochronous system, since an air gap of very small dimensions must be used, i.e. of negligible dimensions compared to the amplitude of oscillation of the resonator coupling element. In such situations, it would be useful to have a mechanism that makes it possible to offset the residual anisochronism produced by a non-ideal escapement.

There is another situation where such an isochronism correction mechanism would be useful. Indeed, it should be kept in mind that it is the whole oscillator, composed of the resonator maintained by the escapement, which must be isochronous. It may happen that the operation of the free resonator varies with amplitude, in other words by itself, i.e. without maintenance of oscillations, the resonator is not isochronous. In such a situation, it would be useful to be able to offset the anisochronism of the resonator by the anisochronism of the maintenance of oscillations.

SUMMARY OF THE INVENTION

The invention proposes to produce an isochronous mechanical oscillator, comprising a flexible strip resonator maintained by a magnetic escapement.

To obtain an isochronous resonator, the anisochronism of the resonator must be offset by the anisochronism of the delay at the escapement. The isochronism corrector is an improvement to the escapement whose function is to achieve this compensation.

The invention therefore concerns anoscillator comprising a flexible strip resonator whose oscillations are maintained by a magnetic escapement with an isochronism corrector.

The invention concerns a timepiece movement according to claim 1.

The invention also concerns a watch including at least one movement of this type.

The invention also concerns a magnetic escape wheel according to claim 11.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

The present description is based, in a non-limiting manner, on the magnetic escapement mechanism described in WO Patent 2015/097172.

The invention combines such an escapement mechanism with a mechanism that makes it possible to produce controlled anisochronism, the function of which is to:

offset the residual anisochronism of a non-ideal escapement, and/or offset the residual anisochronism of a non-ideal flexible strip resonator.

In a particular embodiment, the escape wheel is arranged with magnets in a particular configuration, and in areas which make it possible to produce a low controlled perturbation of the rate variation of the oscillator due to the maintenance oscillations.

Figure 1:
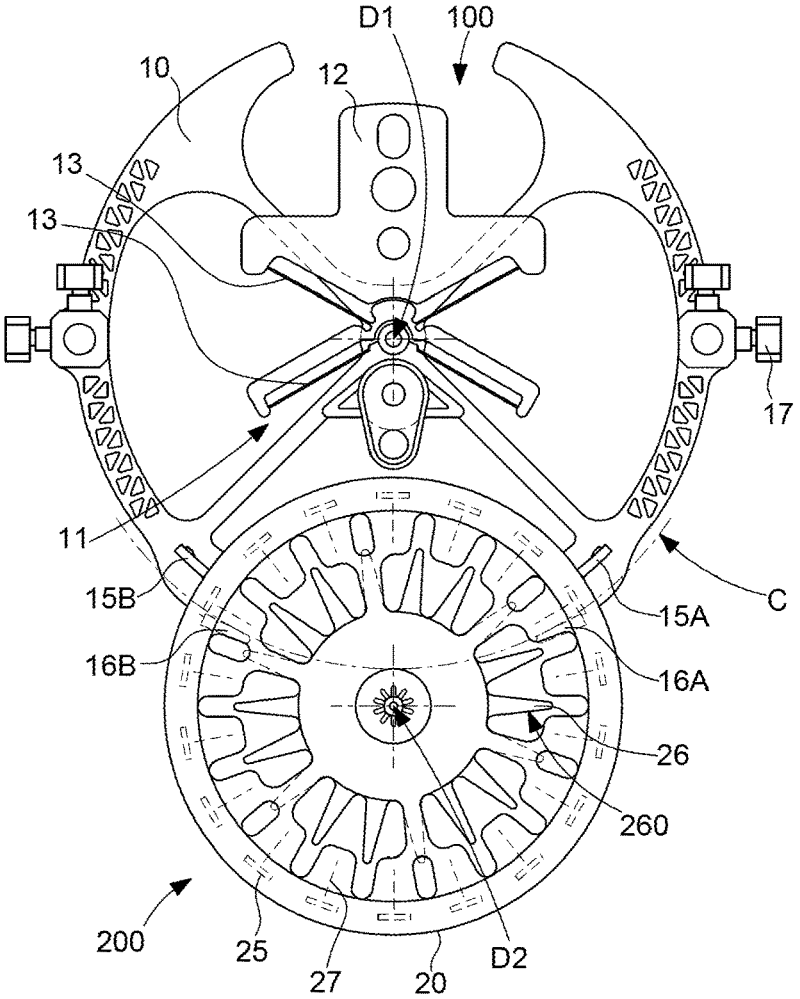
FIG. 1 shows a schematic plan view of an oscillator mechanism according to the invention.
Figure 2:
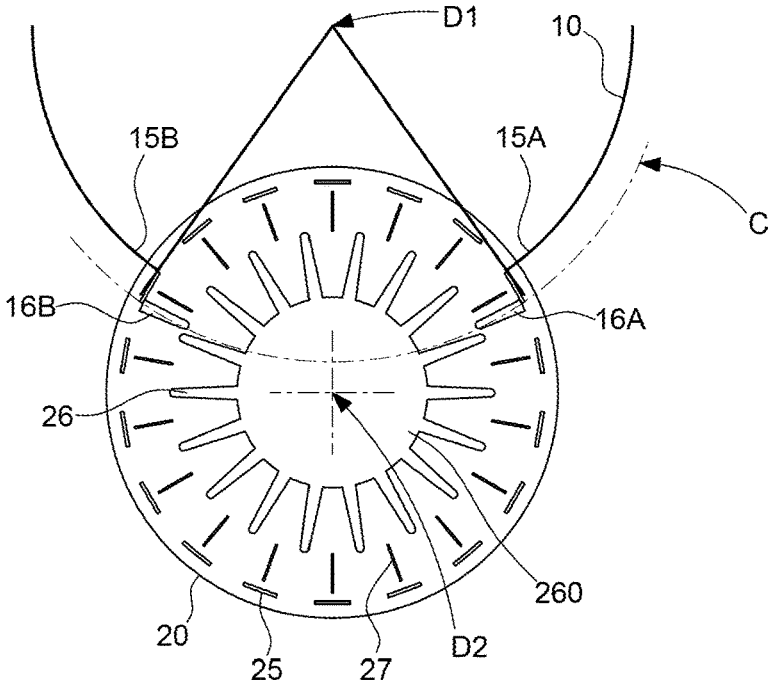
FIG. 2 represents, in a similar manner to FIG. 1, only the magnetized areas of the inertial element of the resonator and of the escape wheel set, and the mechanical components of the inertial element of the resonator and of the escape wheel forming anti-disengagement stops.
Figure 3:
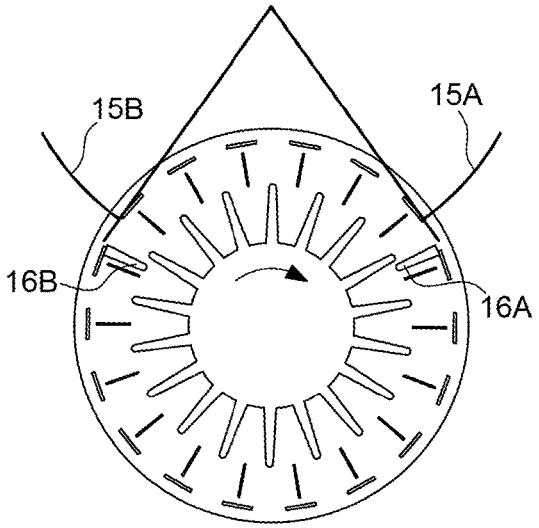
FIGS. 3 to 10 represent, in a similar manner to FIG. 2, the operation of the magnetic escapement, at moments separated by one-eighth of a period.
Figure 4:
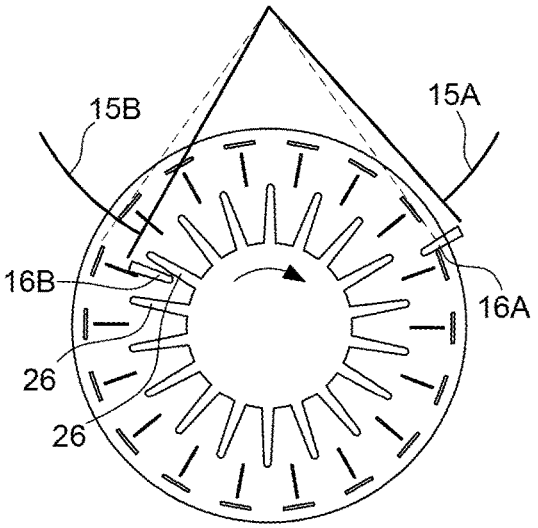
Figure 5:
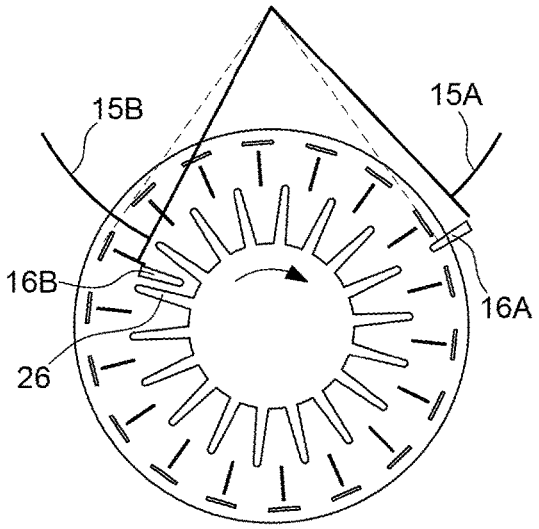
Figure 6:
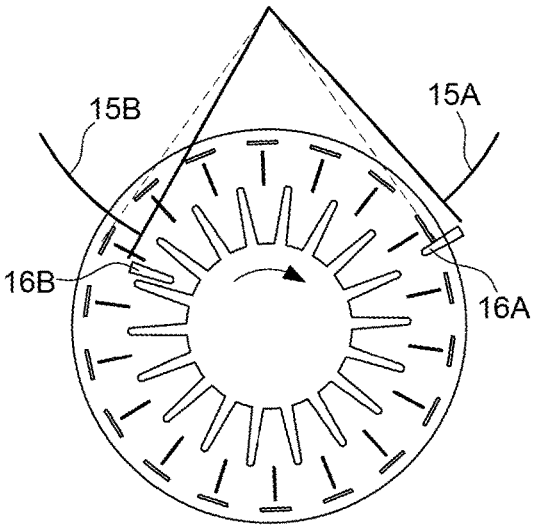
Figure 7:
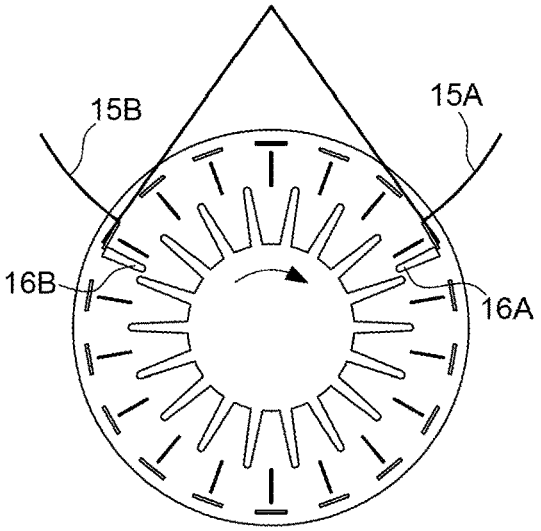
Figure 8:
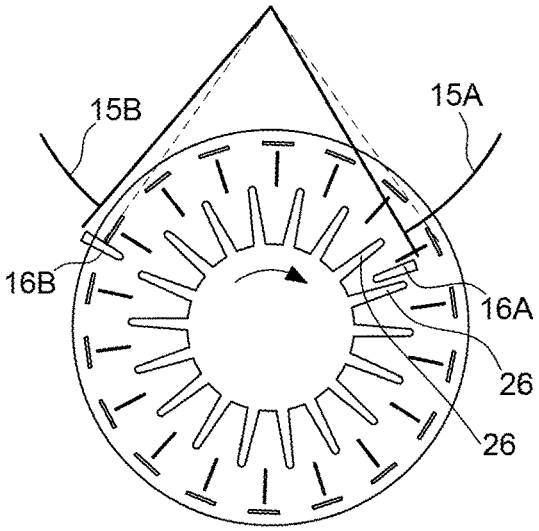
Figure 9:
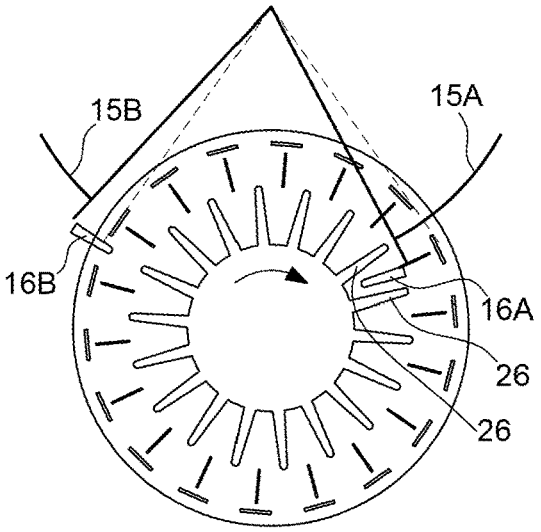
Figure 10:
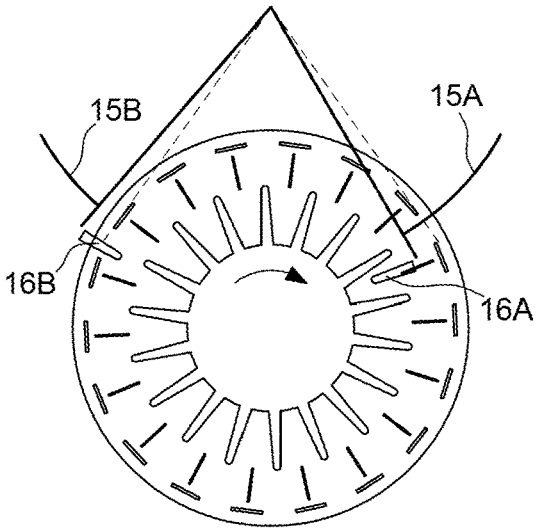
Figure 11:
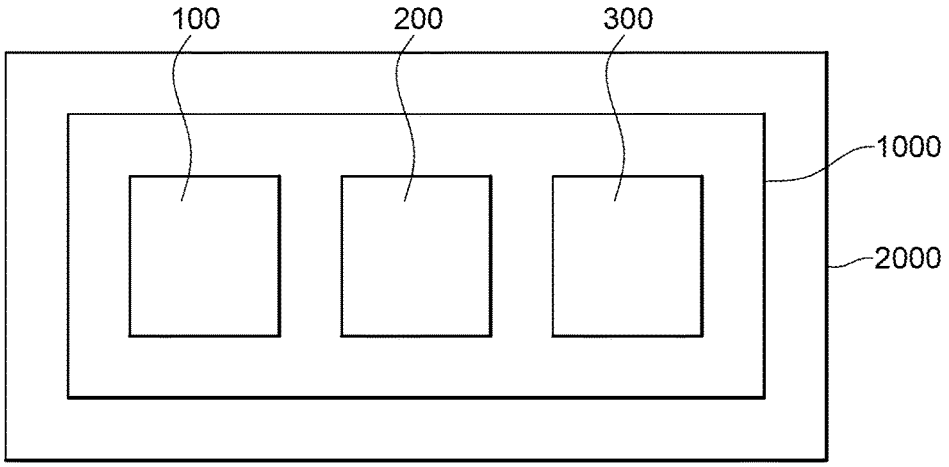
FIG. 11 is a block diagram featuring a watch including such an oscillator and an energy source.

An oscillator according the invention is illustrated in FIGS. 1 to 2. This oscillator includes a flexible strip resonator, whose oscillations are maintained by a magnetic escapement. Two magnets located on the inertial wheel set of the resonator are sandwiched here between two discs, comprised, in this particular, non-limiting case, in the escape wheel. Naturally, the magnetic escapement mechanism may also be on a single level.

These resonator magnets are arranged to repel the escape wheel magnets. It is important to note that there is no contact between the resonator and the escape wheel.

Particularly, at least one disc of the escape wheel includes a first row of peripheral, tangential, or substantially tangential magnets, referred to hereinafter as "tangential magnets", which are the magnets intended to cooperate with the resonator magnets by repelling the latter.

More particularly, at least one disc of the escape wheel includes a second row of compensating magnets, whose function is to adjust the delay at the escapement, so as to offset any anisochronism of the resonator, to obtain an oscillator which, as a whole, is isochronous.

In an advantageous and non-limiting embodiment illustrated in the Figures, these compensating magnets are radial, or substantially radial, and are referred to hereinafter as "radial magnets".

FIGS. 3 to 10, which are separated from each other by one-eighth of a period, illustrate the operation of the magnetic escapement, wherein the two resonator magnets are repelled in turn by the tangential magnets of the escape wheel.

More precisely, during the first vibration visible in FIGS. 3 to 6, one of the tangential magnets of the escape wheel is drawing near to the position of the magnet on the right, called the first magnet, of the resonator which is thus repelled to the right, and the magnet on the left, called the second magnet, of the resonator then enters the escape wheel air gap in an area where there is no tangential magnet.

During the second vibration, visible in FIGS. 3 to 6, it is the second resonator magnet (on the left) that is repelled to the left by a tangential magnet of the wheel, whereas the first resonator magnet (on the right) enters the escape wheel air gap.

The isochronism corrector is a result of the cooperation between compensating magnets of the escape wheel and the first or the second magnet of the resonator.

Indeed, during the first vibration, the resonator progresses freely between t=T/8 and 3T/8. During this time, the operation of the oscillator can be affected by positioning the magnets, and in particular these radial magnets, in proximity to the resonator magnet that penetrates the escape wheel. The same applies to the second vibration between t=5T/8 and 7T/8.

Generally, the residual anisochronism that requires correction is low, whether it is from the escapement or from the resonator. Care must be taken to produce a variation in operation that is reliable, and whose value varies with the amplitude of oscillation.

In the example illustrated in the Figures, the compensating magnets have been selected to be substantially in the radial direction on the wheel, or strictly in the radial direction of the wheel as illustrated in the Figures, in an area adjacent to the trajectory of the resonator magnet. In this manner, it is the low leakage field of these compensating magnets, particularly the radial magnets, that interacts with the resonator magnet and consequently which produces a low variation in operation. The dimensions (length, width) of the radial magnets, and their radial position, are finely adjusted so that the dependency of the variation in operation on the amplitude of oscillation exactly offsets the residual anisochronism of the resonator or of the escapement. This adjustment must be made on a case by case basis, by adapting the geometry of the radial magnets. It is to be noted that the width may also be variable according to radial distance.

Advantageously, in order to ensure that the oscillator is not disengaged in the event of a violent shock, the mechanism includes mechanical anti-disengagement stops: the escape wheel is provided with a star and the inertial element of the resonator, notably a balance, is provided with two fingers. These elements act as mechanical stops in the event of a shock which could cause the magnetic escapement to become disengaged. This particular geometry, with two fingers on the inertial element, makes it possible to obtain complete security in the following sense: at all times, one of the two fingers penetrates the area of the stops which are located on the wheel, in order to ensure the anti-disengagement function in the event of a shock. It is to be noted that there is no mechanical contact between these elements during normal operation of the magnetic escapement.

More particularly, with reference to the Figures, mechanical timepiece movement 1000 includes a strip resonator mechanism 100, which includes at least one inertial element 10 oscillating about a first pivot axis D1 under the action of mechanical elastic return means 11.

These mechanical elastic return means 11 include a plurality of flexible strips 13 fixed, on the one hand, directly or indirectly, to a structure 12 of resonator mechanism 100, and on the other hand, directly or indirectly, to at least one inertial element 10.

This resonator mechanism 100 is coupled to a magnetic escapement mechanism 200, which includes at least one escape wheel set 20 pivoting about a second pivot axis D2, and which is subjected to a torque exerted by at least one source of energy 300, such as a barrel or suchlike.

At least one such inertial element 10 includes at least two first magnetized areas 15 at its periphery, arranged to cooperate directly with second magnetized areas 25 comprised in an escape wheel set 20 and in partial superposition therewith in projection onto a projection plane perpendicular to first pivot axis D1, with only one first magnetized area 15 cooperating with at least one second magnetized area 25 of escape wheel set 20 at any time.

According to the invention, this at least one escape wheel set 20 includes a plurality of second tangential magnetized areas 25, which are each arranged substantially tangentially, and each arranged to repel one of first magnetized areas 15.

Movement 1000 includes isochronism correction means combining, on the one hand, some of the first magnetized areas 15, and on the other hand, compensating magnets 27, arranged on the at least one escape wheel set 20.

Each compensating magnet 27 is arranged in proximity to a second nearby tangential magnetized area 25, and produces a leakage field in a different direction to that of the field of the second nearby tangential magnetized area 25.

The leakage field intensity is low compared to that of the field of the second nearby tangential magnetized area 25. This leakage field is dimensioned to interact with one of first magnetized areas 15, and produce a low variation in the operation of resonator mechanism 100.

Preferably, at least one escape wheel set 20 includes a plurality of such compensating magnets 27, which form radial magnetized areas arranged to limit the delay at the escapement, in cooperation with the first magnetized areas 15 comprised at the periphery of an inertial element 10, to ensure the isochronism of resonator mechanism 100.

More particularly, each compensating magnet 27 extends facing or perpendicular to a second tangential magnetized area 25.

To ensure the anti-disengagement function, in an advantageous variant, at least one inertial element 10 includes, at its periphery, two fingers 16 extending radially, with respect to the first pivot axis D1, beyond first magnetized areas 15. Also, escape wheel set 20 includes, alternated with second tangential magnetized areas 25, a plurality of stops, notably radial stops 26, each centred on second pivot axis D2, and arranged to form mechanical anti-disengagement means, in cooperation with one of stop fingers 16. The selected geometry, with two fingers 16 on the inertial element, allows complete security to be obtained in the following sense: at all times, one of the two fingers 16 penetrates the area of stops which are located on the wheel, in order to ensure the anti-disengagement function in the event of a shock. Complete security is thus ensured for resonator mechanism 100, as a result of the arrangement of this plurality of radial stops 26, which is arranged to cooperate, at all times, with one or other of stop fingers 16.

More particularly, radial stops 26 together form a star 260 centred on second pivot axis D2.

More particularly, fingers 16 extend substantially in a circle C centred on first pivot axis D1.

More particularly, compensating magnets 27 extend radially, with respect to second pivot axis D2, beyond the radial reach of radial stops 26.

In a particular variant, at least one inertial element 10 includes a plurality of adjustable inertia-blocks 17, making possible both frequency adjustment, and adjustment of the position of the centre of inertia of inertial element 10, or of the entire mobile unit of resonator 100, on first pivot axis D1.

More particularly, resonator mechanism 100 is a crossed strip resonator, wherein mechanical return means 11 include a plurality of strips 13 extending on substantially parallel levels, at a distance from each other, and, in projection onto the projection plane, intersecting at first pivot axis D1.

The invention also concerns a watch 2000 including at least one movement 1000 of this type.

The invention further concerns a magnetic escape wheel 20 arranged to pivot about a second pivot axis D2, and comprising magnetized areas 25 at its periphery. According to the invention, the second magnetized areas 25 are each arranged substantially tangentially, and magnetic escape wheel 20 includes compensating magnets 27, wherein each compensating magnet 27 is arranged in proximity to a second nearby tangential magnetized area 25, and produces a leakage field in a different direction to that of the field of second nearby tangential magnetized area 25, and the leakage field intensity is low compared to that of the field of the second nearby tangential magnetized area 25.

More particularly, each compensating magnet 27 extends perpendicular to a second tangential magnetized area 25.

More particularly, escape wheel set 20 includes, alternated with second tangential magnetized areas 25, a plurality of radial stops 26 each centred on second pivot axis D2 and arranged to form mechanical anti-disengagement means.

More particularly, radial stops 26 together form a star 260 centred on second pivot axis D2.

More particularly, compensating magnets 27 extend radially, with respect to second pivot axis D2, beyond the radial reach of radial stops 26.

What is claimed is:

1. A mechanical timepiece movement comprising a strip resonator mechanism that includes at least one inertial element oscillating about a first pivot axis under the action of mechanical elastic return means comprising a plurality of flexible strips, fixed, on the one hand, directly or indirectly, to a structure of said resonator mechanism, and on the other hand, directly or indirectly, to said at least one inertial element, said resonator mechanism being coupled to a magnetic escapement mechanism, which includes at least one escape wheel set pivoting about a second pivot axis and subjected to a torque exerted by at least one source of energy, and said at least one inertial element including at least two first magnetized areas at the periphery thereof, arranged to cooperate directly with second magnetized areas comprised in one said escape wheel set and in partial superposition therewith in projection onto a projection plane perpendicular to said first pivot axis, wherein said at least one escape wheel set includes a plurality of said second tangential magnetized areas each arranged substantially tangentially, and each arranged to repel one of said first magnetized areas, and further wherein said movement includes isochronism correction means combining, on the one hand, said first magnetized areas of said at least one inertial element, and, on the other hand, compensating magnets on said at least one escape wheel set, each said compensating magnet being arranged in proximity to one said second nearby tangential magnetized area and producing a leakage field in a different direction from that of the field of said second nearby tangential magnetized area, and said leakage field intensity being low compared to that of the field of said second nearby tangential magnetized area, and said leakage field being dimensioned to interact with one of said first magnetized areas of said at least one inertial element and to produce a low variation in the operation of said resonator mechanism.

2. The movement according to claim 1, wherein said at least one escape wheel set includes a plurality of said compensating magnets, which form radial magnetized areas arranged to limit the delay at the escapement, in cooperation with said first magnetized areas comprised at the periphery of said at least one inertial element, to ensure the isochronism of said resonator mechanism.

3. The movement according to claim 1, wherein each said compensating magnet extends facing or perpendicular to a said second tangential magnetized area.

4. The movement according to claim 1, wherein said at least one inertial element includes, at the periphery thereof, two fingers extending radially, with respect to said first pivot axis, beyond said first magnetized areas, and in that said escape wheel set includes, alternated with said second tangential magnetized areas, a plurality of radial stops each centred on said second pivot axis and arranged to form mechanical anti-disengagement means, said plurality of radial stops being arranged to cooperate, at all times, with one or other of said stop fingers, to ensure complete security of said resonator mechanism.

5. The movement according to claim 4, wherein said radial stops together form a star centred on said second pivot axis.

6. The movement according to claim 4, wherein said fingers extend substantially in a circle centred on said first pivot axis.

7. The movement according to claim 4, wherein said compensating magnets extend radially, with respect to said second pivot axis, beyond the radial reach of said radial stops.

8. The movement according to claim 1, wherein said inertial element includes a plurality of adjustable inertia blocks permitting adjustment of the position of the centre of inertia of said inertial element on said first pivot axis.

9. The movement according to claim 1, wherein said resonator mechanism is a crossed strip resonator, said mechanical return means including a plurality of strips extending on substantially parallel levels, at a distance from each other, and, in projection onto said projection plane, intersecting at said first pivot axis.

10. A watch including at least one movement according to claim 1.

11. A magnetic escape wheel arranged to pivot about a second pivot axis, and comprising magnetized areas at the periphery thereof, wherein said second magnetized areas are each substantially tangentially arranged, and in that said magnetic escape wheel includes compensating magnets, each said compensating magnet being arranged in proximity to a said second nearby tangential magnetized area and producing a leakage field in a different direction to that of the field of said second nearby tangential magnetized area, and the intensity of said leakage field being low compared to that of the field of said second nearby tangential magnetized area.

12. The magnetic escape wheel according to claim 11, wherein each said compensating magnet extends perpendicular to a said second tangential magnetized area.

13. The magnetic escape wheel according to claim 11, wherein said escape wheel set includes, alternated with said second tangential magnetized areas, a plurality of radial stops each centred on said second pivot axis and arranged to form mechanical anti-disengagement means.

14. The magnetic escape wheel according to claim 13, wherein said radial stops together form a star centred on said second pivot axis.

15. The magnetic escape wheel according to claim 13, wherein said compensating magnets extend radially, with respect to said second pivot axis, beyond the radial reach of said radial stops.

* * * * *